United States Patent [19]

Miller

[11] 4,172,217

[45] Oct. 23, 1979

[54] FOOT PEDAL FOR A MOTOR CONTROL DEVICE

[75] Inventor: Gilbert Miller, Great Neck, N.Y.

[73] Assignee: Mercury Electric Products Mfg. Corp., New Hyde Park, N.Y.

[21] Appl. No.: 893,485

[22] Filed: Apr. 4, 1978

[51] Int. Cl.[2] ..... H01H 21/26

[52] U.S. Cl. ..... 200/86.5; 200/340; 200/153 C; 74/514

[58] Field of Search ..... 74/512, 513, 514, 560, 74/478, 478.5; 200/61.7, 86.5, 153 C, 330, 336, 339, 340; 338/108, 153; 16/171, 172, 174

[56] References Cited

U.S. PATENT DOCUMENTS

| | | | |
|---|---|---|---|
| 1,345,080 | 6/1920 | Flegel | 200/153 C |
| 3,103,905 | 9/1963 | Althens | 74/478 |
| 3,432,882 | 3/1969 | Farouche | 16/171 |
| 3,497,908 | 3/1970 | Zamarra | 16/171 |
| 3,703,698 | 11/1972 | Normura | 338/108 |
| 3,952,369 | 4/1976 | Erickson | 16/171 |
| 3,963,890 | 6/1976 | Straihammer | 74/512 |

*Primary Examiner*—Gerald P. Tolin
*Attorney, Agent, or Firm*—Joseph Levinson

[57] ABSTRACT

A foot pedal is provided for operating a motor-control switch. The foot pedal consists of a housing and pedal which have an internally molded hinge construction for pivotally mounting the pedal on the housing. The foot pedal also contains a flat spring mounted on the pedal and positioned over a motor-control switch such that when the foot pedal is actuated, the flat spring functions to control the movement of the switch of the motor-control circuit. The flat spring also keeps the pedal positioned on the housing, and isolates the interior housing from over-travel.

6 Claims, 4 Drawing Figures

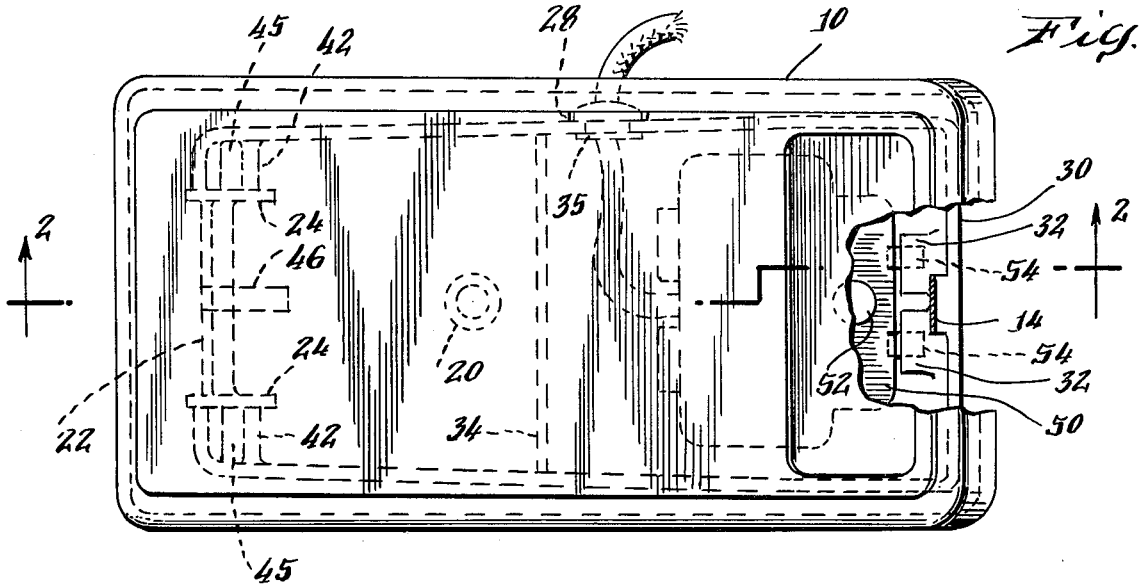
Fig. 1.
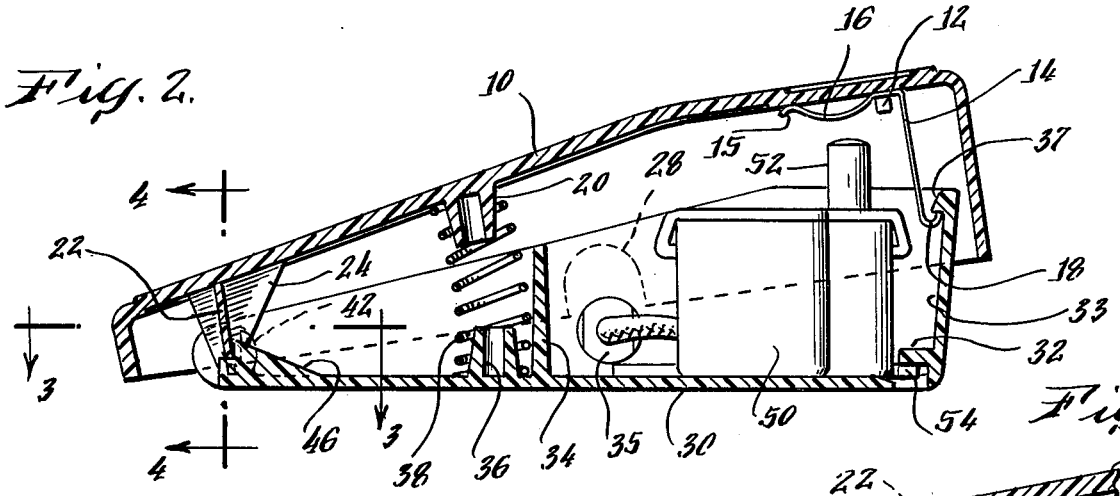
Fig. 2.
Fig. 5.
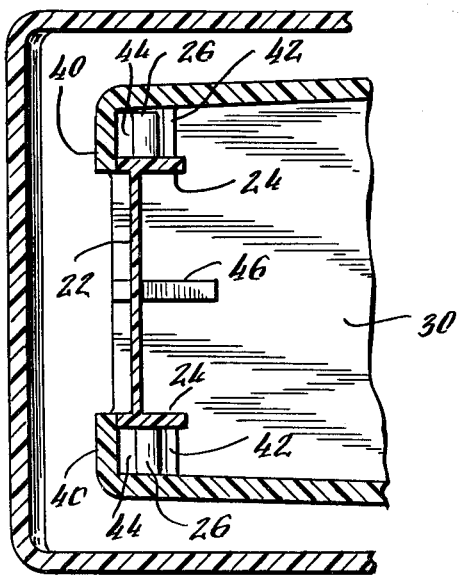
Fig. 3.
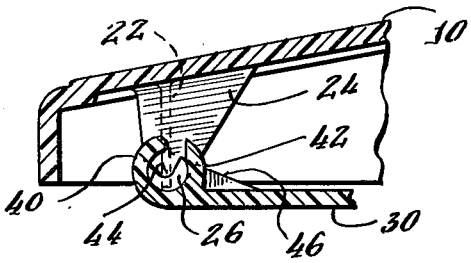
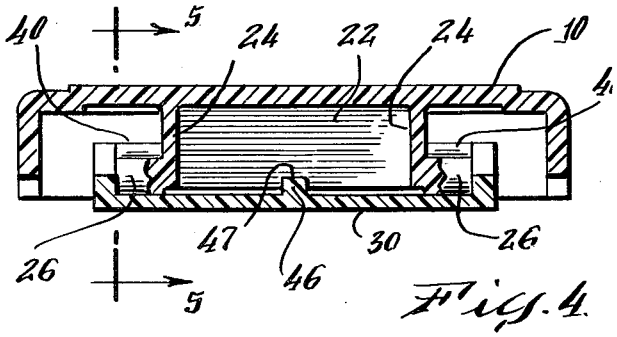
Fig. 4.

FOOT PEDAL FOR A MOTOR CONTROL DEVICE

BACKGROUND OF THE INVENTION

This invention relates to a foot pedal for operating a motor-control switch, for example of the type particularly useful for controlling sewing machines.

Many different types of foot pedals have been used for operating motor-control switches and circuits. One of the most common types used requires a pedal hinged on a support which must be thrust down by the user to regulate the speed, for example, of a sewing machine motor. These pedals tend to be bulky and generally require sturdy and separate pin structure for providing the pivot.

It is an object of the present invention to provide a new and improved foot pedal which is simpler in construction, has fewer parts, is easier to assemble, is less expensive, and yet is comparable in performance and operation to known foot pedals.

SUMMARY OF THE INVENTION

In carring out this invention in one illustrative embodiment thereof, a foot pedal is provided for operating a motor-control switch which comprises a housing adapted to receive a push-button operated motor-control switch therein, and a foot pedal which is mounted on and fits over the housing. The housing and the foot pedal are provided with cooperative integral pivot means along one end portion thereof for pivotaly mounting the pedal to the housing. Spring means are provided on the other end of the foot pedal adjacent the push-button switch and riding on a portion of the housing for contacting the push button when the pedal is depressed, and maintaining the position of the pedal with respect to the housing.

BRIEF DESCRIPTION OF THE DRAWINGS

FIG. 1 is a top view of the foot pedal of the present invention.

FIG. 2 is a cross-sectional view taken along line 2—2 of FIG. 1.

FIG. 3 is a cross-sectional view taken along line 3—3 of FIG. 2.

FIG. 4 is a cross-sectional view taken along line 4—4 of FIG. 2.

FIG. 5 is a cross-sectional view taken along line 5—5 of FIG. 4.

DESCRIPTION OF THE PREFERRED EMBODIMENT

Referring now to FIGS. 1 and 2, a foot pedal 10 is mounted by an integral hinge assembly 45 to a housing 30 for pivotal movement thereon accorded by the hinge assembly 45. The housing 30 is provided with a divider 34 which is adapted to house, in the forward compartment thereof, a motor-control unit or circuit 50 which is actuated by push-button 52. The motor-control circuit may be of any suitable type, e.g. the circuit described in patent application Ser. No. 852,218. The motor-control circuit 50 has feet 54 thereon which are adapted to be inserted into hollow ridges 32 in the housing 30.

As best seen in FIG. 2, the foot pedal has positioned adjacent one end portion thereof overlying the push button 52, a flat spring 15 which is mounted through an opening therein on a post 12 on the interior of the foot pedal 10. Flat spring 15 is bowed at 16, and the bowed section 16 is adapted to contact and depress the push button 52 when foot pressure is applied to the foot pedal 10. Flat spring 15 also contains a downward arm 14 having a curved finger 18 which is adapted to ride on an interior surface 33 of the housing 30. A spring-retaining post 20 is positioned at an intermediate point on the foot pedal 10 for positioning and retaining a coil spring 38 thereon. Near the extremity to the left of FIG. 2, a web 22 is provided across a portion of the foot pedal 10. The web 22 is terminated at its outer extremities in triangular shaped legs 24 which terminate with outward arcuate extensions 26 thereon (see FIG. 5). A notch 47 (see FIG. 4) is provided in the center of the web 22 for a purpose to be described later. The web 22, the legs 24, and the arcuate extensions 26 are an integral part of the foot pedal 10 and form one part of the hinge structure 45.

The remaining portion of the hinge structure 45 is formed as an integral part of one end of the housing 30. The housing 30 is terminated in a curved arcuate wall 40 on one end thereof, and a partly curved projection 42 opposite the arcuate wall 40 to form a channel 44 therebetween.

An indented rib 46 is positioned in the center of the housing 30 (see FIGS. 4 and 5), and is adapted to receive in its indentation the notch 47 of the web 22. The notch 47 in the web 22 is slightly wider than the rib 46, thereby maintaining a close lateral relationship between the pedal 10 and the housing 30. The rib 46 supports any downward pressure from the foot pedal 10, thereby taking the load off of the arcutate projections 26. The height of the notch 47 is such that it acts as a pivot in the indentation of the rib 46 for the foot pedal 10 about the housing 30.

The arcuate walls 40, projections 42, along with the channels 44 formed therein and the indented rib structure 46 are adapted to position and support for pivotal movement therein the arcuate projections 26 from the legs 24 and the notch 47 of the web 22.

The housing 30 also includes a spring retaining post 36 which has the other end of coil spring 38 positioned thereon with the spring 38 also extending to and being positioned on the post 20 of the foot pedal 10. When the foot pedal is actuated, the spring 38 is compressed, and functions to return the foot pedal to its normal inactivated position when foot pressure is released. The housing 30 contains an opening for accommodating electrical connections to the circuit 50 and a strain relief insert 35 for the wiring. A cooperating notch 28 is provided in the foot pedal 10 in order to provide clearance for the wiring and strain relief insert 35.

The housing 30 has a projection 37 above its interior surface 33 which cooperates with the finger 18 of the flat spring 15 to retain the pedal 10 in proper position on the housing 30. When the foot pedal 10 is depressed, the finger 18 of the flat spring 15 rides down the interior surface 33 of the housing 30. When the bowed section 16 of the flat spring 15 comes into contact with the push button 52, the bowed section depresses the push button. If too much pressure is applied to the foot pedal, pushing the button as far as it will go, in other words reaching the extreme end of the travel provided by the push button, the bowed section will bend to provide overloading protection for the push button. When the foot pressure is released, the finger 18 will ride up the interior surface 33 of the housing 30 until it comes into contact with the projection 37. At this point the foot pedal 10 is returned to its initial position, and the flat spring 15 functions to keep the pedal on the housing 30 and in proper position for the next actuation.

Although not limited thereto, the foot pedal structure in accordance with the present invention is preferably molded from a strong plastic material, such as polystyrene. The hinge structure 45 is preferably molded as parts of the foot pedal 10 and the housing 30. The assembly of the structure then becomes quite simple; the foot pedal 10 is rotated until it is at approximately 90° to the housing, at which point the arcuate projections 26 are inserted into the channels 40 and rocked forward. The configuration of the channel which covers approximatey 270° prevents the dislodgment of the hinge structure once it is it is inserted. The arcuate projections 26 are then free to pivot within the positioning means or channels 44.

This integral hinge construction requires fewer parts, and facilitates ease of assembly and operation. There are no screws, bolts, nuts, rivets, pins or other metal parts accessible to the user, which provides an extra measure of insulation to prevent shock in case of faulty operation or shorting of the motor-control circuit housed therein. The construction utilizing the flat spring isolates the motor control from undersirable impact, and the spring deflects when the push button has reached its maximum stroke, providing a measure of protection to prevent damage to the motor-control circuit housed in the foot pedal. The retaining feature of the flat spring limit the opening travel of the pedal in relation to the housing, and keeps the two together as well as providing a measure of tamper-proof construction.

The hinge structure is simple, with all the components being maintained in a definite spatial relationship to confine the motion of the pedal 10 to a rotation in the housing 30. The finger 18 of the spring 15 in conjunction with projection 37 limits the rotation. Furthermore, the notch 47 and indented rib 46 configuration serves to constrict lateral movement parallel to the axis of rotation of the pedal 10 in the housing 30 to very narrow limits.

Since other modifications and changes will be apparent to those skilled in the art, the invention is not considered limited to the examples chosen for purposes of disclosure, and covers all modifications and changes which do not constitute a departure from the true spirit and scope of this invention.

What I claim is:

1. A foot pedal for operating a motor control switch comprising:

(a) a housing adapted to mount a motor control switch therein adjacent a first end portion thereof, (b) an integral pivot positioning means located on a second end portion thereof, (c) a foot pedal pivotally mounted on and fitting over said housing, (d) an integral pivot means on said foot pedal positioned in said pivot positioning means of said housing for pivotally mounting said foot pedal on said housing, (e) contact means mounted on an inner surface of said foot pedal which is adapted to overlie a motor control switch and to contact the motor control switch when the foot pedal is depressed, and (f) said contact means comprising a spring having an arm extending therefrom which is in contact with and rides on an interior surface of said first end portion of said housing when said foot pedal is actuated.

2. The foot pedal set forth in claim 1 wherein said first end portion of said housing has a projection thereon for restricting the travel of said arm of said flat spring.

3. A foot pedal for operating a motor control switch comprising:

(a) a housing adapted to mount a motor control switch therein adjacent a first end portion thereof, (b) an integral pivot positioning means located on a second end portion thereof having spaced and slotted arcuate channels positioned near opposed edges thereof which are in alignment across the width of said housing and an indented rib positioned between said channels, (c) a foot pedal mounted on and fitting over said housing, (d) an integral pivot means on said foot pedal including arcuate projections thereon which are mounted in said integral pivot positioning means through said spaced and slotted channels and held therein for pivotal movement in said spaced and slotted channels of said housing thereby pivotally mounting said foot pedal on said housing, and (e) contact means mounted on an inner surface of said foot pedal adapted to contact a motor control switch positioned in said housing.

4. The foot pedal set forth in claim 3 wherein said integral pivot means includes a notched web having said arcuate projections on opposite ends thereof, said notch being positioned therebetween and pivoting on said indented rib.

5. A foot pedal for operating a motor control switch comprising:

(a) a housing member adapted to house a motor control switch therein, (b) a foot pedal member pivotally mounted on said housing member, (c) one of said members having a socket means formed as an integral part thereof, (d) extension means formed as an integral part of said other member, said extension means being pivotally mounted in said socket means thereby providing said pivotal mounting for said foot pedal on said housing, and (e) contact means mounted on an inner surface of said foot pedal member adapted to contact a motor control switch housed in said housing member, (f) said contact means comprising a spring having an arm extending therefrom which is in contact with and rides on an interior surface of a first end portion of said housing when said pedal is actuated, said first end portion having a projection thereon for restricting the travel of said arm of said spring.

6. A foot pedal for operating a motor control switch comprising:

(a) a housing member adapted to house a motor control switch therein, (b) a foot pedal member pivotally mounted on said housing member, (c) a socket means formed as an integral part of said housing member having slotted and spaced arcuate channels positioned near opposed edges in alignment across the width of said housing member, (d) an indented rib positioned on said housing member between said channels, (e) extension means formed as an integral part of said foot pedal member comprising a notched web having arcuate projections on opposite ends thereof with said notch being positioned therebetween and pivoting on said indented rib, said extension means being pivotally mounted in said socket means thereby providing said pivotal mounting for said foot pedal on said housing, and (f) contact means mounted on an inner surface of said foot pedal member adapted to contact a motor control switch housed in said housing member.

* * * * *